United States Patent [19]

Piken

[11] Patent Number: 4,619,014

[45] Date of Patent: Oct. 28, 1986

[54] SCALP CLEANER

[76] Inventor: Stuart Piken, 351 E. 84th St., New York, N.Y. 10028

[21] Appl. No.: 704,511

[22] Filed: Feb. 22, 1985

[51] Int. Cl.[4] ..... A47K 7/04

[52] U.S. Cl. ..... 15/244 R; 15/210 R

[58] Field of Search ..... 15/244 R, 210 R

[56] References Cited

U.S. PATENT DOCUMENTS

| | | | |
|---|---|---|---|
| 126,945 | 5/1872 | Finn | 15/118 X |
| 1,127,244 | 2/1915 | Helstrom | 15/244 R X |
| 2,955,308 | 10/1960 | Nelson | 15/118 X |
| 3,164,853 | 1/1965 | Peeler | 15/244 R |
| 3,568,235 | 3/1971 | Aston | 15/244 |
| 3,568,237 | 3/1971 | Rhodes | 15/244 |
| 3,717,898 | 2/1973 | Jones | 15/244 R |

FOREIGN PATENT DOCUMENTS

| | | | |
|---|---|---|---|
| 559728 | 6/1923 | France | 15/244 R |
| 723815 | 1/1932 | France | 15/244 R |

*Primary Examiner*—Chris K. Moore

[57] ABSTRACT

This invention relates to scalp cleaners, and more particularly to a scalp cleaner usable to clean a scalp to which is fixedly attached a hair piece. The cleaner consists of a rounded, thin cleaning member, such as a sponge, mounted on a flexible handle. The flexibility of the invention allows access to heretofore inacessible fringe areas.

1 Claim, 2 Drawing Figures

SCALP CLEANER

FIELD OF THE INVENTION

The present invention relates to a device which can be inserted under a hairpiece to allow the scalp to be cleaned.

BACKGROUND OF THE INVENTION

Hairpieces, toupees and wigs, collectively referred to herein as hairpieces, are attached to the scalp through surgical techniques, sewn to existing hair, taped or stretched over the scalp. Cleaning the scalp when the hairpiece is affixed, particularly along the underside fringe areas where the hairpiece adjoins the scalp, is difficult to accomplish. This operation is made more difficult when the hairpiece is tightly affixed to the scalp, thus limiting the space available between the hairpiece and scalp.

Prior art discloses body cleaning devices such as back washers or scrubbers which are not designed to be inserted within the limited space between the hairpiece and scalp or to reach fringe areas where the hairpiece is adjoined to the scalp.

Hence it is an object of this invention to disclose a single device which can be readily inserted under a hairpiece to clean the non-planar contoured area of the scalp when only limited altitudinal space is available for insertion and cleaning manipulations.

It is a further object to provide a device which can reach the fringe areas of the scalp under the hairpiece where the hairpiece is adjoined to the scalp.

These objects will become evident upon reading the ensuing disclosure, aided by the accompanying drawings in which.

DETAILED DESCRIPTION

Figure 1:
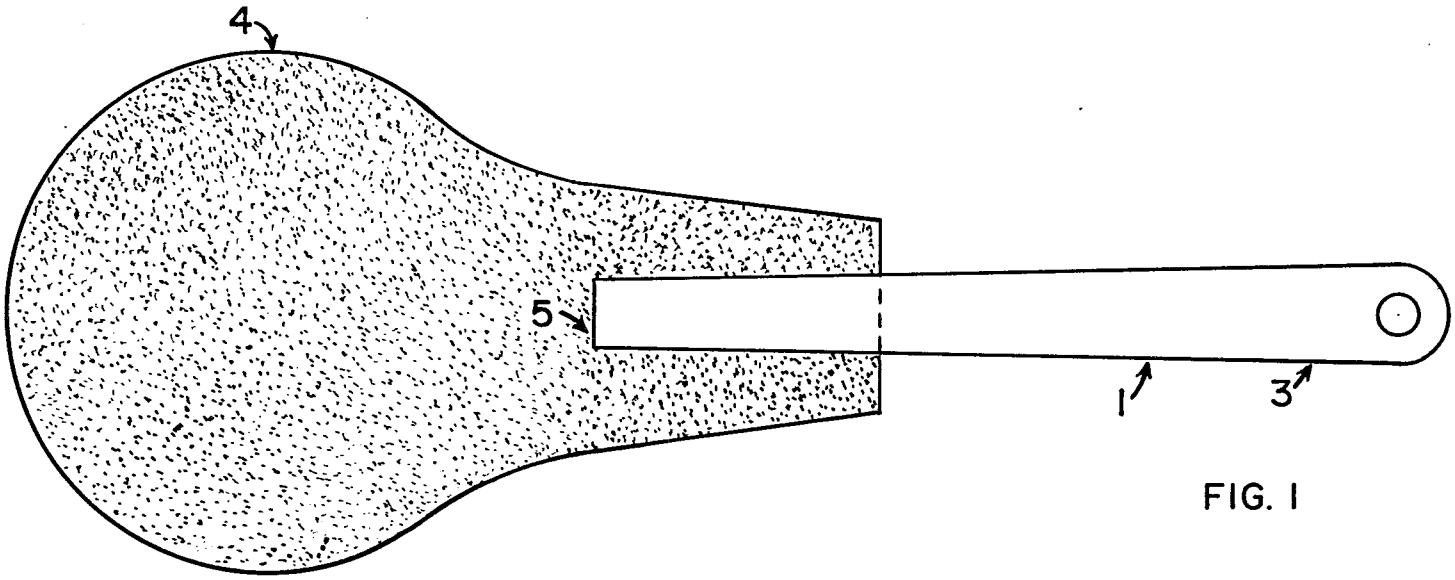
FIG. 1 is a top view of the present invention, the Scalp Cleaner, as taken from the top.

Referring to FIG. 1, the Scalp Cleaner 1 consists of a sponge 2 attached altitudinally beneath a portion of the elongated handle 3. The sponge 2, preferably made of cellulose or similar plastic material is sufficiently rounded along its edge 4 to allow fringe areas of the scalp under the hairpiece to be reached. The handle 3 is comprised of plastic or similar material sufficiently elongated and narrow to allow it to be held in the hand of the user. The handle 3 can be glued 5 or otherwise attached to the sponge 2 at the general location shown on FIG. 1 so as to be interposed between the hairpiece and sponge during cleaning manipulations.

Figure 2:
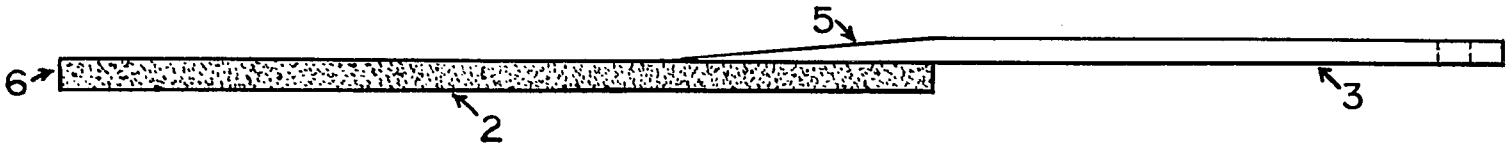
FIG. 2 is an elevation view of the present invention taken substantially at right angles to the view of FIG. 1.

Referring to FIG. 2, the sponge 2 is sufficiently thin 6 and flexible to allow its insertion under a hairpiece to reach otherwise inaccessible areas of the scalp. The handle 3 is also similarly thin and flexible affixed altitudinally above and generally parallel to the direction of the sponge 2 as shown.

OPERATION

The invention functions as follows:

The hairpiece is lifted a sufficient amount to allow the sponge 2 of the Scalp Cleaner 1 to be inserted into the limited altitudinal space created between the hairpiece and non-planar contoured area of the scalp. This is accomplished by holding handle 3 in the hand and sliding the sponge 2 under the hairpiece moving same about the scalp to desired areas. The thinness and flexibility of the sponge 2 and handle 3 said handle being interposed between the hairpiece and sponge 2 to allow unimpeded access to heretofore inaccessible fringe areas of the scalp during cleaning manipulations. The Scalp Cleaner 1 can then be removed, cleaned, and reinserted as necessary to clean the scalp as desired.

The above description should not be construed as a limitation on the scope of the invention, but rather as an exemplification of one preferred embodiment thereof. Other variations are possible. For example, the shape of sponge 2 and thickness 6 may be varied depending upon the particular hairpiece or shape of scalp. The handle 3 may be affixed altitudinally above the sponge 2 by varied means including a mechanism which would allow the sponge 2 to be removed from the handle 3 and replaced as needed. Accordingly, the scope of the invention would be determined not by the embodiment illustrated, but by the appended claims and their legal equivalents.

I claim:

1. A scalp cleaning device capable of insertion between the scalp and a hairpiece secured to the scalp along the perimeter of a non-planar contoured area of the scalp over which the hairpiece is juxtaposed, the hairpiece being secured altitudinally closely adjacent the contoured area of the scalp such that only limited altitudinal space is available for insertion and cleaning manipulations of the scalp cleaning device between the hairpiece and the contoured area of the scalp, said scalp cleaning device comprising:

an elongate handle; and a cleaning member, such as a sponge, affixed to the elongate handle to enable said cleaning manipulations of the cleaning member;

the elongate handle and the cleaning member being flexible and relatively thin in the altitudinal direction so as to enable flexible conformance of the scalp cleaning device to the non-planar contour of the contoured area during said cleaning manipulations with minimal force against the hairpiece, whereby said cleaning manipulations are facilitated within the confines of said limited altitudinal space;

the cleaning member being located altitudinally beneath a portion of the elongate handle such that said portion of the handle is interposed between the hairpiece and the cleaning member during said manipulations.

* * * * *